US005826743A

United States Patent [19]

Baird

[11] Patent Number: 5,826,743

[45] Date of Patent: Oct. 27, 1998

[54] TRAY FOR SLOT MACHINE GAMING DEVICE

[76] Inventor: Bruce R. Baird, 617 St. Dunstans Rd., Baltimore, Md. 21212

[21] Appl. No.: 877,765

[22] Filed: Jun. 17, 1997

[51] Int. Cl.[6] ..... A45C 11/28

[52] U.S. Cl. ..... 220/480; 220/481; 206/8

[58] Field of Search ..... 206/8, 82, 83, 206/84; 220/480, 481

[56] References Cited

U.S. PATENT DOCUMENTS

| | | | |
|---|---|---|---|
| 1,754,363 | 4/1930 | Kee . | |
| 1,839,948 | 1/1932 | Brunhoff . | |
| 1,890,587 | 12/1932 | Plym . | |
| 2,051,131 | 8/1936 | Crow | 133/11 |
| 2,149,612 | 3/1939 | Madsen | 220/480 |
| 2,641,359 | 6/1953 | Garofalo | 206/19.5 |
| 2,927,684 | 3/1960 | Sudler | 220/480 |
| 2,948,391 | 8/1960 | McLeod | 206/81 |
| 3,245,522 | 4/1966 | Pearson | 206/81 |
| 3,306,462 | 2/1967 | Cruz | 206/84 |
| 3,316,924 | 5/1967 | Ware | 206/84 |
| 3,329,277 | 7/1967 | Gaudino | 206/84 |
| 3,606,008 | 9/1971 | Lusetti | 206/84 |
| 3,908,853 | 9/1975 | Keesling | 220/480 |
| 4,314,632 | 2/1982 | Hutchinson | 206/81 |
| 4,489,831 | 12/1984 | Lahneman III | 220/480 |
| 4,535,921 | 8/1985 | Sanders | 220/480 |
| 4,638,908 | 1/1987 | Baitz et al. | 206/84 |
| 4,846,333 | 7/1989 | Kissick | 206/800 |
| 4,867,506 | 9/1989 | Chavez | 297/188 |
| 5,641,007 | 6/1997 | Falk | 220/571 |

*Primary Examiner*—Joseph M. Moy
*Attorney, Agent, or Firm*—Leonard Bloom

[57] ABSTRACT

A tray to be attached to a slot machine gaming device. The tray has a concave upper surface and an opening to cooperate with the coin accepting slot of the slot machine. The tray is manually removably attached to the slot machine.

1 Claim, 4 Drawing Sheets

TRAY FOR SLOT MACHINE GAMING DEVICE

BACKGROUND OF THE INVENTION

The present invention relates to a tray for a slot machine and more particularly to a tray for coins which is removably attached to the slot machine.

Players playing a slot machine gaming device hold a plurality of coins in one hand or in a container while the other hand is used to operate the slot machine and to place coins into the coin receptor slot on the slot machine. This fully occupies both hands of the player and prevents the player from knowing the amount of, and controlling the coins.

U.S. Pat. No. 1,754,363 to Kee discloses a change tray combined with an advertising device. The tray is self supporting. U.S. Pat. No. 1,839,948 to Brunhoff discloses an advertising change tray which is not attached to another device. U.S. Pat. No. 1,890,587 to Plym discloses a tilting receptacle. U.S. Pat. No. 2,051,131 to Crow discloses a money receptacle which may be readily and easily clamped with a clip to the rim of a curb-service tray, providing a place for the customer to place money for the payment for articles. Garofalo in U.S. Pat. No. 2,641,359 discloses an automobile accessory, which is a tray for holding coins found necessary for use in parking meters and which may be attached to the dash of an automobile. McLeod in U.S. Pat. No. 2,948,391 discloses a serving tray with built-in means for receiving coins and bills, with the coin receptacle arranged in the tray in such a manner as to facilitate removing coins therefrom in making change. In U.S. Pat. No. 3,245,522 to Pearson there is disclosed a utility tray useful for disposition in a handy location adjacent to the driver's compartment of a vehicle for filing small articles, like coins. In U.S. Pat. No. 4,314,632, Hutchinson discloses a till insert for coins and currency. In U.S. Pat. No. 4,867,506, Chavez discloses a coin holder attachable to a wheelchair to facilitate a handicapped person having reduced grasping strength. The bottom of the coin holder is curved to allow removal of coins by sliding movement up the side of the coin holder without grasping the coin.

None of these patents are directed to a slot machine gaming device.

BRIEF SUMMARY OF THE INVENTION

It is an object of the invention to provide a tray for a slot machine or for a gaming type of slot machine which has a tray which is removably attached to the machine and which the coins can be received thereon and retained thereon so that the player has his hands free and is not required to hold any coins in his hand. The player can deposit the coins from the tray directly into the machine and continue with his playing. In accordance with the disclosure of the present invention, a tray is adapted to be attached to a coin receiving slot machine of the gaming device. The tray has an upper surface and a lower surface. The lower surface is concave and has an opening therethrough on a back side of the tray. The lower surface has means thereon for positioning and removably attaching the tray to the slot machine. The opening in the tray cooperates with a coin accepting slot in the slot machine and coins may be stored on the upper concave surface of the tray to be available as needed.

These and other objects of the present invention will become apparent from a reading of the following specification taken in conjunction with the enclosed drawings.

DESCRIPTION

Figure 1:
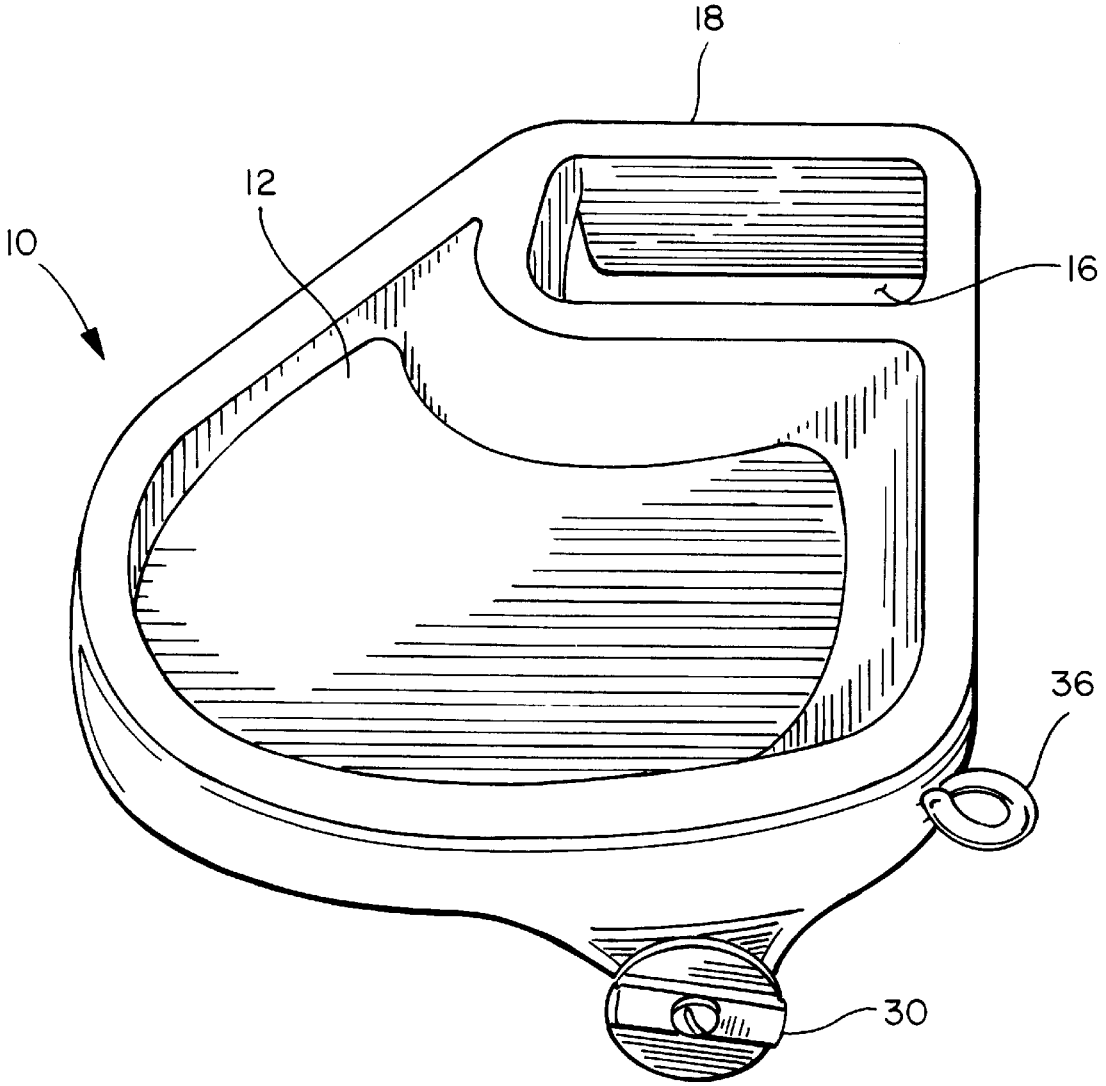
FIG. 1 is a perspective view of the present invention showing the tray and not showing the slot machine.
Figure 2:
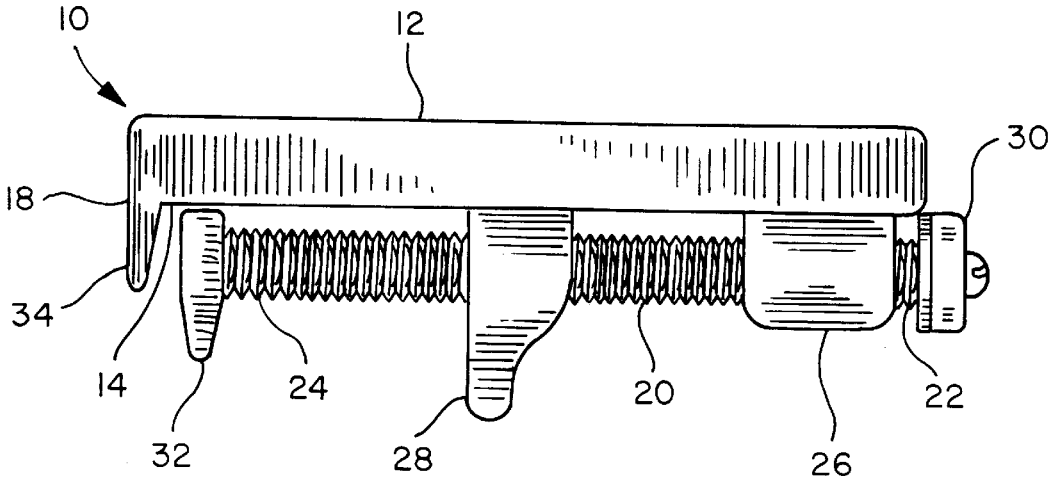
FIG. 2 is a side elevation view of the present invention.
Figure 3:
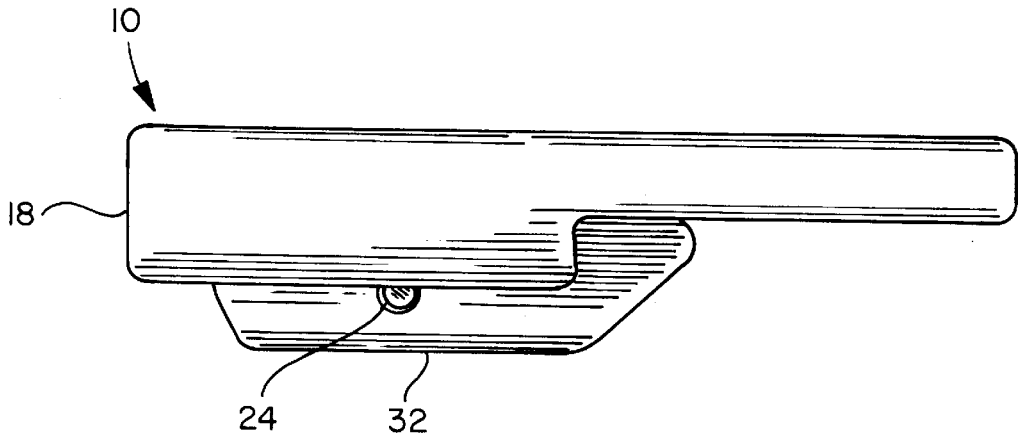
FIG. 3 is a back elevation view of the present invention.
Figure 4:
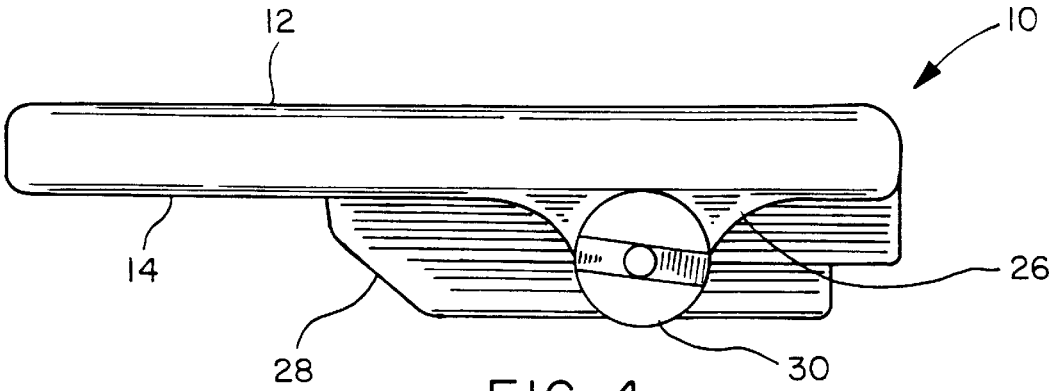
FIG. 4 is a front elevation view of the present invention.
Figure 5:
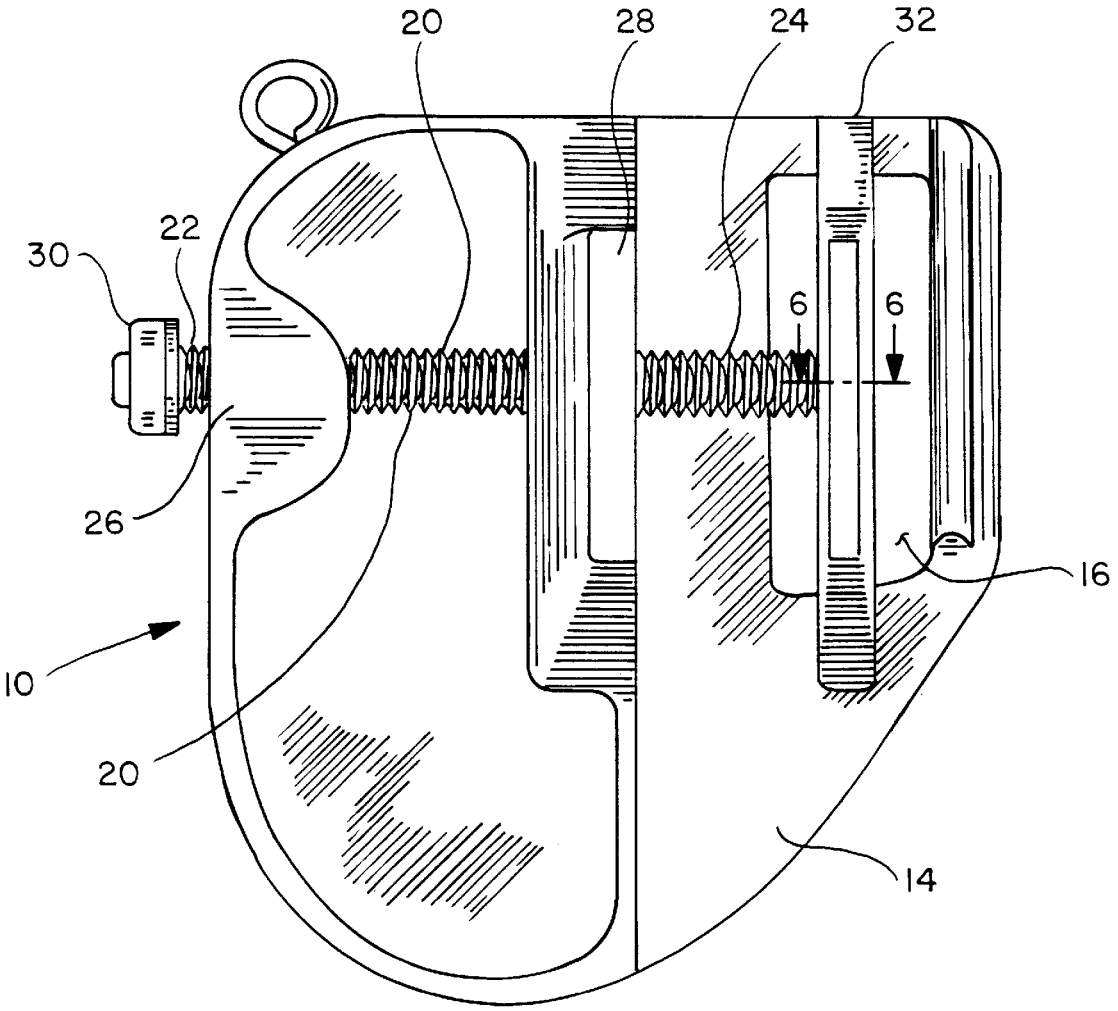
FIG. 5 is a bottom plan view of the present invention.
Figure 6:
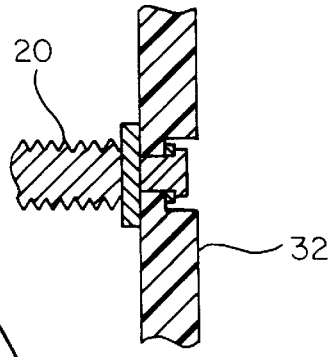
FIG. 6 is a cross-sectional view across the lines 6—6 of FIG. 5.
Figure 7:
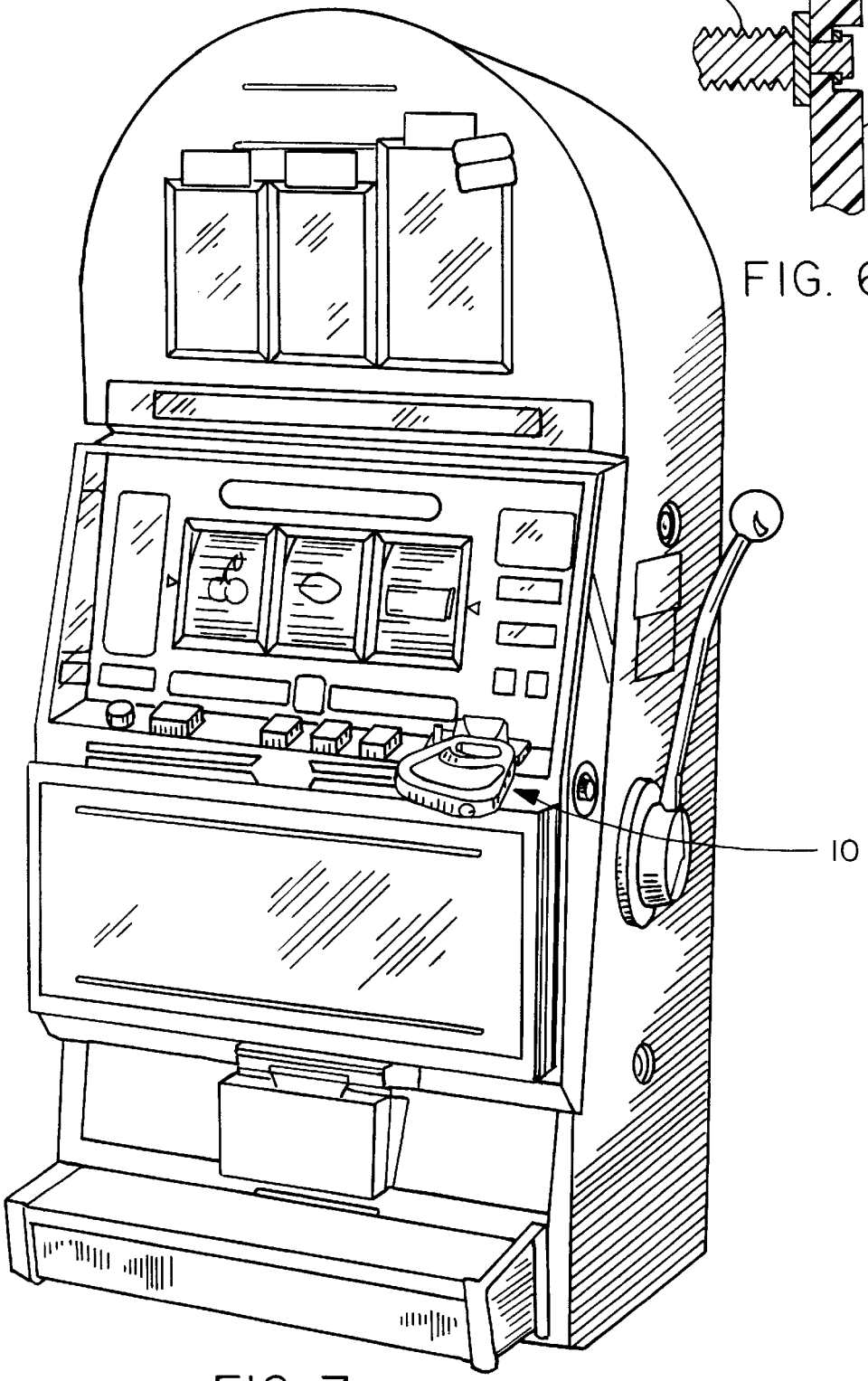
FIG. 7 is a perspective view showing the present invention attached to a slot machine.

Referring now to the drawings there is disclosed a tray 10 which has an upper surface 12 and a lower surface 14. On the back side of the tray 18 there is an opening 16 formed therein which goes through the tray and, when the tray is connected to the slot machine, the opening cooperates with a coin depositing slot in the machine. On the bottom side of the tray there is a threaded shaft having a first end 22 and an opposite second end 24. There are supports or suspension means on the bottom of the tray in which the threaded shaft is received and which hold the threaded shaft onto the bottom of the tray. Preferably, a first support 26 is near the front side of the tray and a second support 28 is at approximately the mid point of the tray. Attached to the first end of the threaded shaft 20 is a manually graspable member 30 which is used by the player to turn the shaft to removably attach the tray to the slot machine. At the second end of the threaded shaft 20 there is a pusher means 32 which, when the shaft is turned to advance the pusher means against the slot machine, the pusher means is clamped against the slot machine and holds the tray on the slot machine. As shown in FIG. 6, it is preferred that the threaded portion of the shaft 20 terminates at the pusher means 32 and that an unthreaded portion of reduced diameter extend through an opening in the pusher means 32. Preferably, a washer is disposed between the end of the threaded portion and the pusher means. The unthreaded portion of the shaft 20 has a head or enlarged portion formed at the extreme tip of the shaft 20 to retain the pusher means 32 on the shaft 20. It is preferred that a washer be disposed between the pusher means 32 and the enlarged head on the shaft to reduce wear on the pusher means. Other means such as a spring actuated clamp or similar devices known to those skilled in the art can be used to clamp or otherwise attach the tray to the slot machine. Preferably the upper surface of the tray is concave having edges which are sloping so that the coins can be easily deposited on or removed from the tray by the fingers of the player.

The back wall 34 of the opening 16 in the tray 10 extends downwardly from the lower surface 16 to assist in aligning the tray with the coin depositing slot in the machine. The extended back wall 34 also serves as a brace against the slot machine to provide improved stability to the tray 10 when the tray 10 is clamped to the slot machine.

The tray 10 may be formed of any type of material but preferably is formed of plastic which can be molded more economically.

The tray 10 is also provided with a holder means 36 attached to a side thereof. The holder means may be an eye attached to or formed in the tray 10. In the event that the tray 10, or a plurality of trays are to be carried, a belt or strap can be connected to the holder means for transport of the tray or trays. Alternately, if the tray 10 is to be affixed to or retained on a specific slot machine, the holder means 36 may be connected to the slot machine by a chain or other restraining means.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In a tray removably mounted on a slot machine adjacent to the coin-depositing slot thereof, wherein the slot machine has a wall member, and wherein the tray has a back wall, the improvement comprising the back wall of the tray having a depending lip, the tray having a front portion, a back portion and a peripheral wall formed with sloping sides down to the upper surface of the tray, such that coins in the tray may be easily slidably removed therefrom, the tray having a first side which is substantially perpendicular to the back portion and further having a second side which is angled with respect to the back portion, such that the front portion of the tray is wider than the rear portion thereof, the tray further having a bottom surface provided with first and second spaced-apart supports depending therefrom, wherein the first support is near the front portion of the tray, and wherein the second support is intermediate the front and back portions of the tray, a threaded rod carried by the first and second supports and threadably received within one of the supports, the threaded rod having a front end and a rear end, a handle carried by the front end of the threaded rod, and a clamp carried by the rear end of the threaded rod, such that the wall member of the slot machine is rigidly clamped between the clamp on the rear end of the threaded rod and the lip depending from the back wall of the tray.

* * * * *